US005584548A

United States Patent [19]

Miller

[11] Patent Number: 5,584,548

[45] Date of Patent: Dec. 17, 1996

[54] OFFICE ARMOIRE

[75] Inventor: Joseph E. Miller, Naples, Fla.

[73] Assignee: Bush Industries, Inc., Jamestown, N.Y.

[21] Appl. No.: 420,072

[22] Filed: Apr. 11, 1995

[51] Int. Cl.[6] ..... A47B 83/00

[52] U.S. Cl. ..... 312/235.3; 312/311

[58] Field of Search ..... 312/311, 301, 312/235.2, 235.3

[56] References Cited

U.S. PATENT DOCUMENTS

| | | | |
|---|---|---|---|
| 0,888,104 | 5/1908 | Lind | 312/311 |
| 2,004,896 | 6/1935 | Knott | 312/235.3 |
| 2,614,017 | 10/1952 | Mugnier | 312/196 |
| 2,614,018 | 10/1952 | Engel | 312/235 |
| 2,665,963 | 1/1954 | Wallack | 312/235 |
| 2,808,305 | 10/1957 | Jackson | 312/140.2 |
| 2,912,293 | 11/1959 | Jung | 312/301 |
| 2,963,332 | 12/1960 | Breuning | 312/231 |
| 3,592,520 | 7/1971 | Marino | 312/241 |
| 4,236,460 | 12/1980 | Poupko | 108/41 |
| 4,478,467 | 10/1984 | Tyndall | 312/250 |
| 4,736,998 | 4/1988 | Wilson et al. | 312/235 R |

FOREIGN PATENT DOCUMENTS

| | | | |
|---|---|---|---|
| 2613918 | 10/1988 | France | 312/235.3 |

OTHER PUBLICATIONS

"Pocket Desk eases home office space problems", Jul. 20, 1995, p. 7G, *Naples Daily News*.

*Primary Examiner*—Peter M. Cuomo
*Assistant Examiner*—Gerald Anderson
*Attorney, Agent, or Firm*—Webb Ziesenheim Bruening Logsdon Orkin & Hanson, P.C.

[57] ABSTRACT

An armoire is disclosed which can be opened to provide a compact interior office including a tiered desktop. The armoire additionally provides for a shelving support system which can be arranged, as needed, to support, for example, various components of a computer system. The present invention provides space sufficient for the desk to be retracted within the interior of the armoire and to further accommodate a conventional chair within the closed interior of the armoire, thereby hiding the office.

19 Claims, 5 Drawing Sheets

OFFICE ARMOIRE

BACKGROUND OF THE INVENTION

1. Field of the Invention

The present invention relates to an armoire with an interior desk surface and, more particularly, to an armoire having an interior desk surface which can store a conventional chair within the interior of the armoire, thereby providing a completely storable office.

2. Prior Art

There is a need for hideable or storable desktop surfaces. This is particularly true in the home environment where space limitations may not allow an entire room to be dedicated to office use. The wide use of computers adds another design constraint to any desktop storing system. Furthermore, a desktop hiding or storing system which does not account for the associated chair in the stored position has been found to be unsatisfactory. A remaining, detached office chair often is a cumbersome, awkward object which significantly detracts from any benefit of the hidden or stored desktop.

A wide variety of furniture cabinets have been developed which open, fold out or reassemble to provide flat tabletop surfaces with associated chairs. U.S. Pat. Nos. 2,614,018 to Engel; 2,665,963 to Wallack and 2,963,332 to Breuning are illustrative of the variety of designs that have been developed to create a storable desktop working surface. These patents also illustrate the various disadvantages of the prior art systems. In some prior art systems, such as in the Wallack patent, the tabletop surface is not hidden and remains in view when transformed from a table or desk into a standing cabinet. With other designs, the tabletop surface must be cleared, such as the tabletop of the Breuning or Engel patent designs, before being placed back into the stored or closed position. Clearing the tabletop surface when moving the tabletop into the stored position is a severe drawback when the tabletop is utilized as a desk. Additionally, all of these patents require the use of a specialized chair in connection with the tabletop surface representing another limitation of these prior art systems.

It is an object of the present invention to overcome the aforementioned drawbacks of the prior art. It is an object of the present invention to provide a compact, completely hideable office. It is a further object of the present invention to provide an armoire which can provide a hidden desktop surface and further allows for hiding an associated conventional chair within the armoire interior when the desk is in the stored or retracted position. A further object of the present invention is to provide an attractive armoire design with an effective desk which is easily manufactured and easily adaptable to specific user requirements.

SUMMARY OF THE INVENTION

The objects of the present invention are achieved by providing an armoire which includes a pair of spaced sidewalls, a back wall interconnecting the sidewalls, whereby the sidewalls and back wall define a hollow interior. At least one door is attached to at least one of the sidewalls and can be positioned for closing off the hollow interior when in a first closed position. A desk is slidably supported between the sidewalls and is movable between an extended position and a retracted position completely within the hollow interior. The hollow interior is adapted to completely receive a conventional chair therein with the door in the closed position.

In the retracted position, a space may be provided between the front end of the desk and the door in the closed position. This space is adapted to receive a back of the chair which is positioned within the hollow interior. In the extended position, at least a portion of the desk may extend beyond the sidewalls.

In one embodiment of the present invention, a shelf system is positioned within the hollow interior above the desk. The shelf system includes a horizontal base shelf extending between the pair of sidewalls with a gap between the desk and the base shelf, a vertical divider extending up from the base shelf at a position approximately midway between a pair of sidewalls, and at least one adjustable shelf extending between the divider and one of the sidewalls. The shelf system will preferably provide a space between the front of the shelf system and the doors when the doors are in the closed position.

The present invention may also provide a file cabinet having a top, back and pair of spaced sidewalls, and at least one slidable drawer within the file cabinet. In one embodiment of the present invention, the file cabinet is attached to one of the pair of sides and is positioned within the hollow interior. The file cabinet may include a recess formed in a lower portion thereof, whereby the recess is adapted to receive a leg of the chair positioned within the hollow interior when the doors are in the closed position.

The desk of the armoire may include a flat desktop extending between the pair of sidewalls with a pair of vertical end plates attached to an underside of the desktop. A keyboard table may be slidably supported below the desktop extending between the pair of end plates. The desktop may be slidably supported upon outer track runners attached to the pair of end plates with each outer track runner facing one of the sidewalls and with the keyboard table slidably supported upon inner track runners attached to the keyboard table with each inner track runner facing one of the end walls. A wrist rest may be provided on the front portion of the keyboard table.

The armoire of the present invention provides a complete, compact, hideable office environment. With the doors in the closed position and the chair stored within the armoire, the office is completely hidden. These and other advantages of the present invention will be clarified in the description of the preferred invention described together with the attached figures in which like reference numerals represent like elements throughout.

DESCRIPTION OF THE PREFERRED EMBODIMENTS

Figure 1:
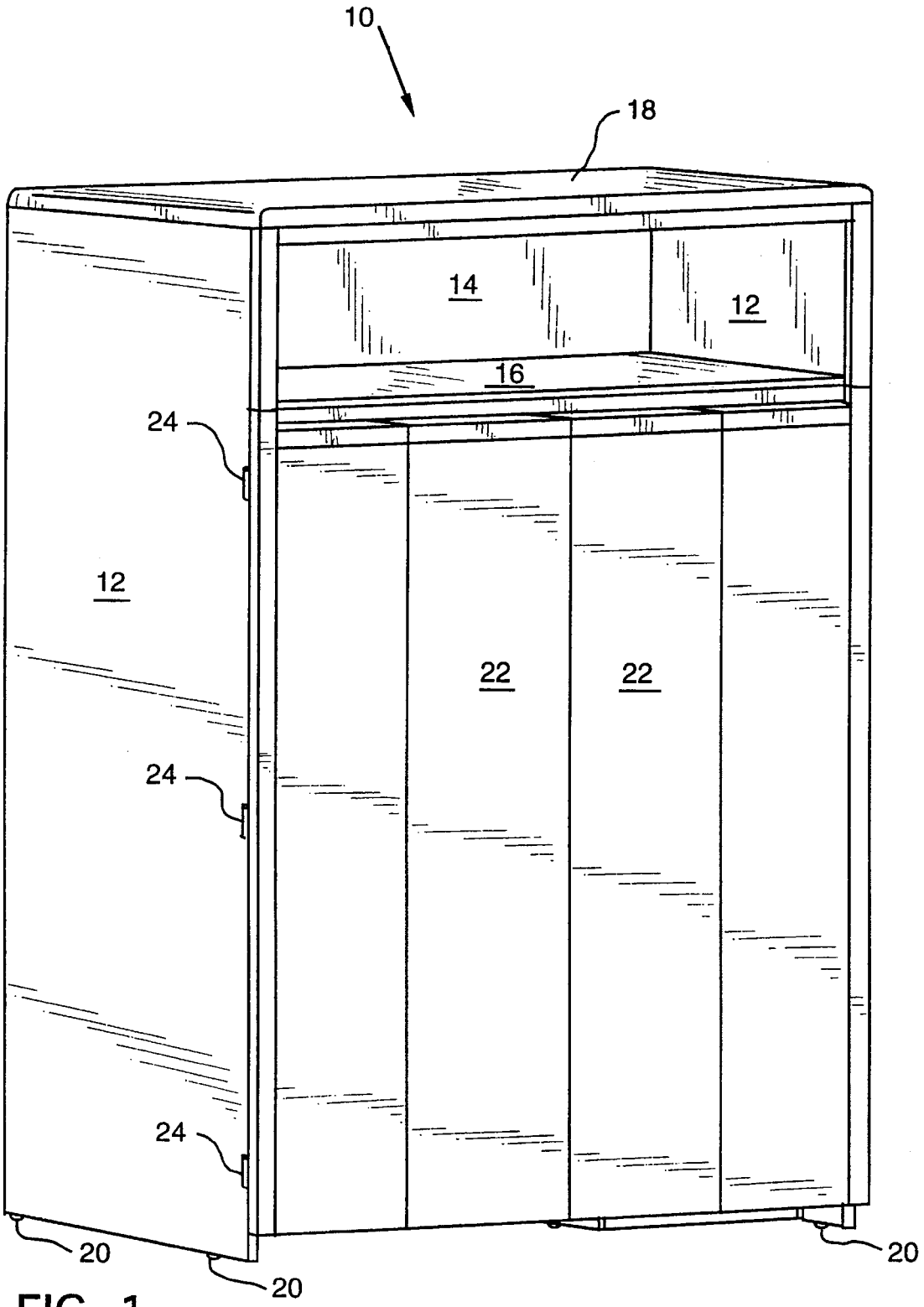
FIG. 1 is a perspective of an armoire according to a first embodiment of the present invention with a pair of doors thereof in the closed position.
Figure 2:
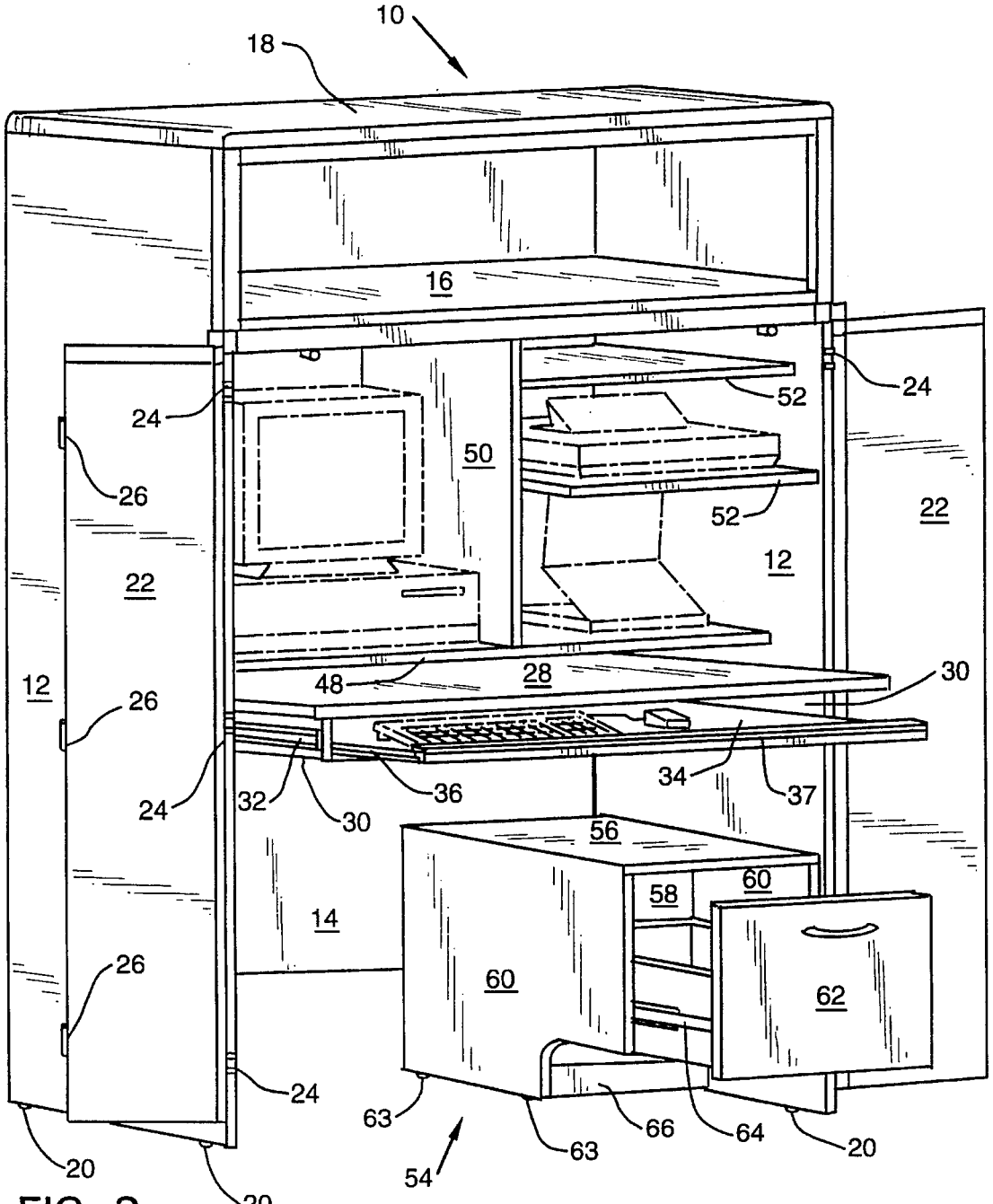
FIG. 2 is a perspective of the armoire illustrated in FIG. 1 with the doors thereof in the open position and a desktop, keyboard table and file cabinet drawer thereof being in an extended position.
Figure 4:
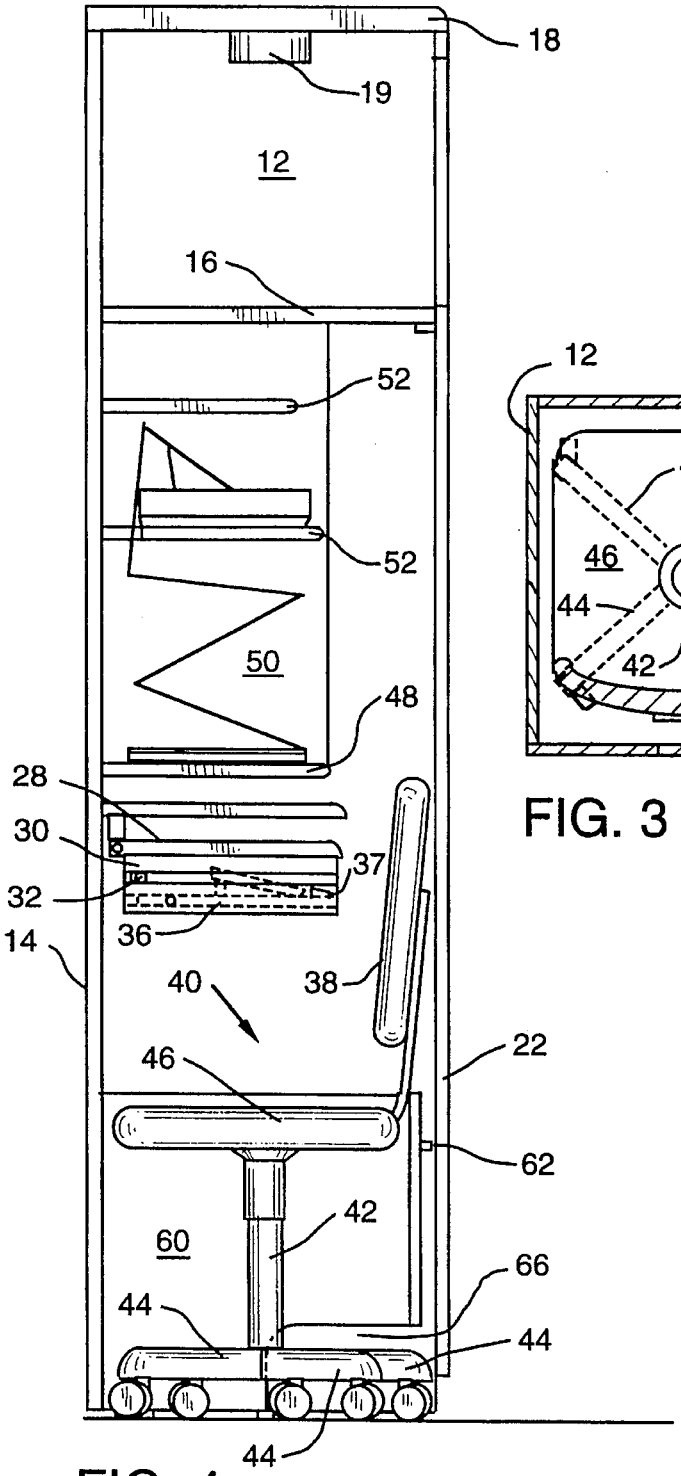
FIG. 4 is a side view of the armoire illustrated in FIG. 1 with a sidewall thereof removed and a shelving unit thereof rearranged from the position shown in FIG. 2.
Figure 3:
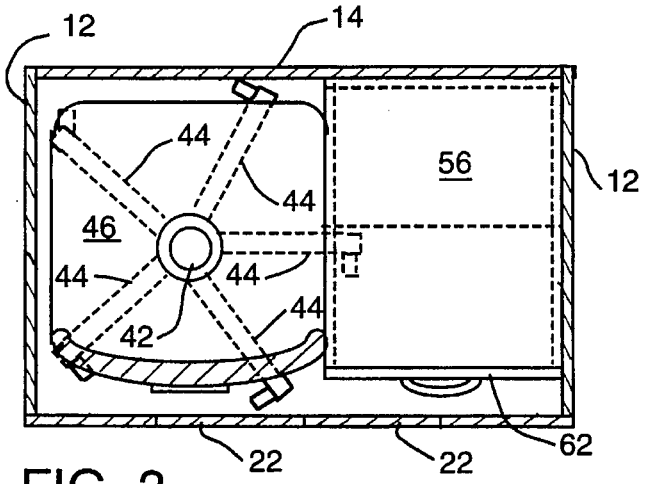
FIG. 3 is a cross-sectional top view of the armoire illustrated in FIG. 1.

The armoire 10 illustrated in FIGS. 1–4 includes a pair of spaced sidewalls 12 with a back wall 14 interconnecting the spaced sidewalls 12. A top wall 16 is attached to the back wall 14 and extends between the sidewalls 12. As illustrated in FIG. 2, the pair of sidewalls 12, the top wall 16 and the back wall 14 define a hollow interior. Additionally, the sidewalls 12 and back wall 14 may extend above the top wall 16 to form an upper shelf capped by a cap member 18 with a top light 19 as shown in FIG. 4. As shown in FIG. 2, the back wall 14 does not extend to the bottom of the sidewalls 12, thereby forming an opening into the hollow interior. The armoire 10 is supported on the floor by feet 20 positioned on the lower edge of the sidewalls 12. The feet 20 are adjustable to provide leveling for the armoire 10.

A pair of bifold doors 22 are attached at the front of the armoire 10. Each door 22 is hinged to a respective sidewall 12 through appropriate hinges 24. Each door 22 includes hinges 26 between the respective door panels. The doors 22 are adapted to pivot between a closed position shown in FIG. 1 closing off the hollow interior and an open position shown in FIG. 2 providing access to the hollow interior. Handles and locks may be incorporated into the doors 22 to provide both functionality and ornamentation to the armoire 10.

Figure 6:
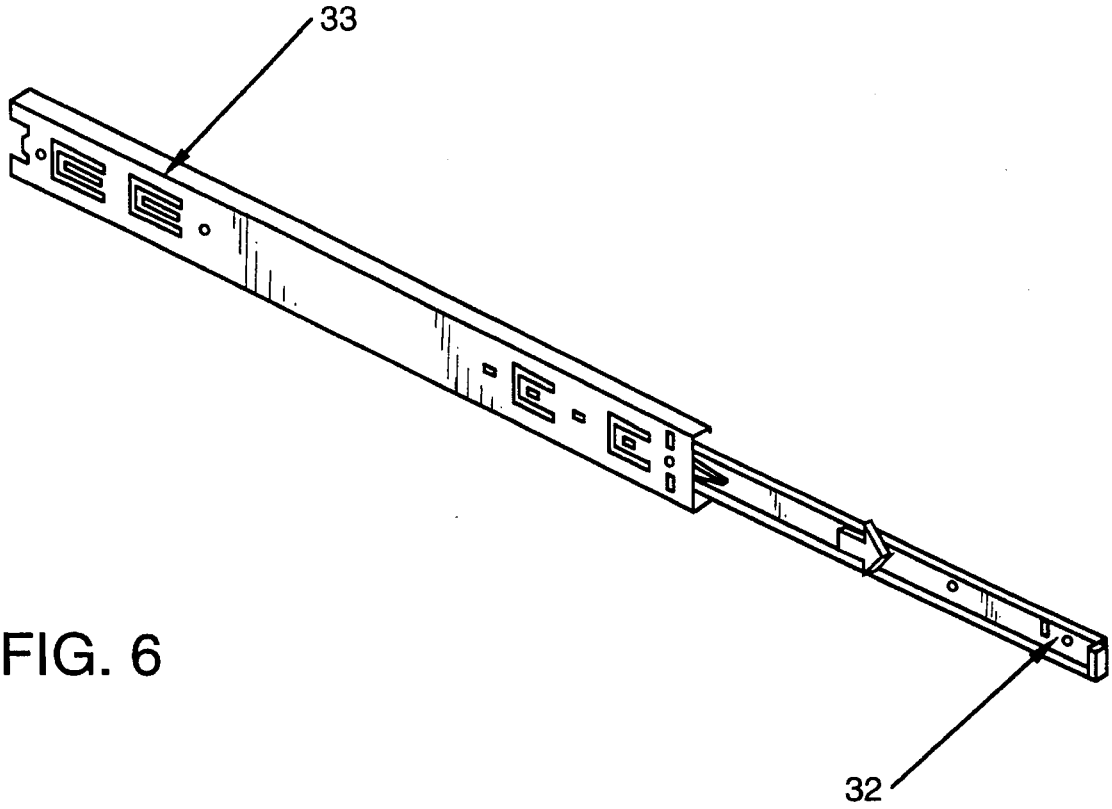
FIG. 6 is a perspective of a track slide and track runner for slidably supporting elements of the armoire shown in FIG. 1.

A desk unit is provided within the hollow interior of the armoire 10 and includes a substantially flat desktop 28 extending between the pair of sidewalls 12. A pair of vertical end plates 30 are attached to the underside of the desktop 28 at opposite ends thereof adjacent each of the sidewalls 12. The desktop 28 is slidably supported upon outer track runners 32, whereby each outer track runner 32 faces one of the sidewalls 12 which includes an appropriate track slide 33 as shown in FIG. 6. A keyboard table 34 is slidably supported below the desktop 28 and extends between the end plates 30. The keyboard table 34 is slidably supported upon inner track runners 36 attached to the edge of the keyboard table 34 communicating with appropriate track slides (not shown) attached to the pair of end plates 30 in substantially the same manner as track runners 32 and track slides 33. Both track runners 32 and 36 may be reversed with respect to the position of the track runner and the track slide. Additionally, other known slide supports may be utilized. A wrist rest 37 is attached to the front top surface of the keyboard table 34. The keyboard table 34 is spaced at a distance below the bottom surface of the desktop 28 to allow sufficient room for a conventional keyboard to be positioned thereon as illustrated in FIG. 2. Such a conventional distance may be 50 to 100 mm. The keyboard table 34 is adapted to be slid into a retracted position completely underneath the desktop 28, as shown in FIG. 4, or an operative position extending out from the front surface of the desktop 28 to allow access to the keyboard held thereon as illustrated in FIG. 2. Appropriate stopping mechanisms can be provided on the keyboard table 34 or within the inner track runners 36 to prevent movement of the keyboard table 34 beyond appropriate limits. As with the keyboard table 34, appropriate stops may be provided on the outer track runners 32 to limit the movement of the desktop 28.

The desk unit, including both the desktop 28 and the keyboard table 34, is slidably supported between the sidewalls 12, as described above, and movable between an extended position wherein at least a portion of the desktop 28 extends beyond the front edge of the sidewalls 12 and a retracted position completely within the hollow interior as shown in FIG. 4. When in the retracted position, a space is provided between the front of the desk unit, which is either the front end of the desktop 28 or the front end of the keyboard table 34 and the closed doors 22. The space is specifically provided to receive a vertically extending back 38 of a conventional office chair 40 which is positioned within the hollow interior of the armoire 10 with the doors 22 closed. The chair 40 includes a central post 42 with a plurality of radially extending legs 44 attached thereto as well as a substantially horizontal seat portion 46. The vertically extending back 38 is attached to the seat portion 46. The distance of the space between the front edge of the desktop 28 and keyboard table 34 and the doors 22 should be sufficient to receive the standard office chair 40 and may be on the order of at least 200 mm. This allows the depth of the desktop 28 to be approximately 400 mm with the depth of the armoire being approximately 600 mm. These dimensions provide both an attractive piece of furniture and sufficient space for the desktop 28 while allowing appropriate clearance for receipt of a standard chair 40 within the armoire interior. The space beneath the desk unit within the hollow interior is sufficiently clear to receive the seat portion 46, legs 44 and central post 42 therein.

The armoire 10 additionally includes a shelf system positioned within the hollow interior above the desk. The shelf system includes a horizontal base shelf 48 extending between the sidewalls 12 with a gap formed between the desktop 28 and the base shelf 48. The provision of the gap between the base shelf 48 and the desktop 28 eliminates the need for the user to remove all of the items from the desktop 28 when putting the desktop 28 into the retracted position. The gap should be at least 25 mm to generally allow for elements left on the desktop 28 to be undisturbed when the desktop 28 is positioned in the retracted position. A vertical divider 50 extends up from the base shelf 48 to the top wall 16 at a position substantially midway along the base shelf 48. A plurality of adjustable shelves extends between the divider 50 and one of the sidewalls 12. The adjustable shelves can be positioned in the appropriate location by utilizing pegs and post holes or adjustable L brackets or other conventional shelf attachments as is known in the art. The shelves 52 can be provided on either side of the divider 50 to provide for maximum variation in shelf design. For example, FIG. 4 illustrates the shelves 52 positioned on the opposite side of the divider 50 than shown in FIG. 2. A number of combinations may be provided with the shelf assembly.

The position of the divider 50 may be moved, as appropriate, according to the overall width of the armoire 10. The armoire 10 illustrated in FIGS. 1–4 is approximately 1,000 mm wide. With this width, the divider 50 is positioned substantially midway along the base shelf 48 to allow sufficient space on either side of the divider 50 for the inclusion of a conventional computer monitor and CPU as illustrated in FIG. 2. FIG. 2 also illustrates that the shelf system has been designed to easily accommodate all of the components of a computer system, including a printer and a printer paper storage position which can feed directly to the printer. As illustrated in FIG. 4, a space is provided between the front of the shelving system and the doors 22 when the doors 22 are in the closed position. This space will receive the back 38, if the back 38 extends this high. Additionally, this arrangement locates the shelving assembly reasonably behind the desktop 28 when the desktop is in the extended operative position.

A file cabinet 54 having a top 56, back 58 and pair of sides 60 and at least one drawer 62 slidably supported therein is provided within the hollow interior attached to a sidewall 12. A plurality of drawers 62 may also be provided. The file cabinet 54 is supported upon adjustable feet 63 attached to a lower edge of the sides 60. The adjustable feet 63 provide for leveling of the file cabinet 54. The drawer 62 is slidably supported upon a track runner 64 which cooperates with a track slide (not shown) in substantially the same manner as track runner 32 and track slide 33 discussed above. The provision of the file cabinet 54 as a stand-alone unit provides added flexibility because the file cabinet 54 may be attached to the opposite sidewall 12 to change the interior design. The file cabinet 54 includes a recess 66 at a lower portion thereof with the recess 66 being adapted to receive at least one of the legs 44 of the chair 40 when the chair 40 is positioned within the hollow interior and the doors 22 are in the closed position. The recess 66 should be about 200 mm deep and 125 mm high to sufficiently receive the legs 44 of a conventional office chair 40.

In operation, the doors 22 can be opened and the desktop 28 moved to the operative position, as shown in FIG. 2, whereby the armoire 10 may be used as a desk with a computer system and a conventional office chair 40, providing an entire compact office. The keyboard table 34 and the shelving unit allow the computer system to be incorporated as shown in FIG. 2. When not in use, the keyboard table 34 and desktop 28 may be moved to the retracted position within the hollow interior along with the chair 40 as shown in FIGS. 1 and 4 to close and hide the office. The closed armoire 10 appears, from the exterior, as an attractive piece of furniture.

Figure 5:
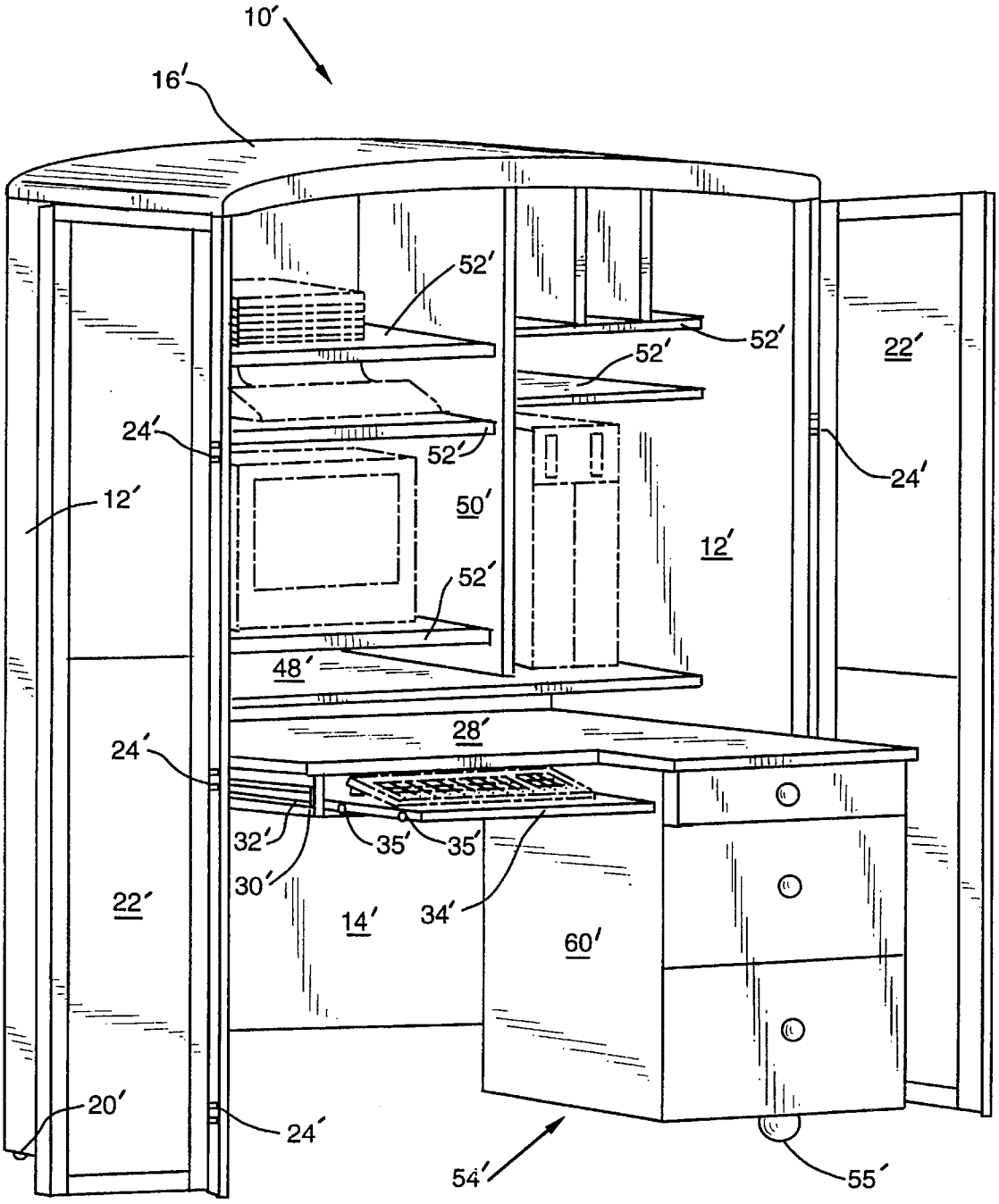
FIG. 5 illustrates an office armoire according to a second embodiment of the present invention.

FIG. 5 illustrates an armoire 10' according to a second embodiment of the present invention. The armoire 10' includes sidewalls 12', back wall 14', top wall 16', feet 20', bifold doors 22', hinges 24', base shelf 48', divider 50' and shelves 52' substantially as described above in connection with the armoire 10 described above. In the armoire 10', a desktop 28' is combined with a file cabinet 54', both of which move on outer track runners 32' between a retracted position within the armoire 10' and an operative position as shown in FIG. 5. A caster 55' is attached to the file cabinet 54' for support. A keyboard table 34' extends between an end plate 30' and a side 60' of the integral file cabinet 54'. Rollers 35' on the edge of the keyboard table 34' engage track slides (not shown) on the end plate 30' and side 60' to slidably support the keyboard table 34'. Rollers 35' represent an alternative to the track runners described above. The desktop 28' includes a cutout portion in a front corner thereof sufficient to receive the back 38 of a chair 40. The armoire 10' allows the file cabinet 54' to be more easily accessible when in the extended operative position.

The armoire of the present invention is adapted to be embodied in a variety of armoire designs, including those set forth in my copending design application Ser. No. 29/034,606 filed Feb. 8, 1995 entitled "Decorative Office Armoire" which is incorporated herein by reference.

It will be apparent to those of ordinary skill in the art that various changes may be made to the present invention without departing from the spirit or scope thereof. Consequently, the scope of the present invention should be defined by the attached claims.

What is claimed is:

1. An armoire and chair combination comprising:

a chair having a central post and a plurality of radially extending support legs extending from said post, a seat portion supported on said post, a vertically extending back portion extending from said seat portion; and said armoire including a pair of spaced sidewalls, a back wall interconnecting said sidewalls, a top wall attached to said back wall and extending between said sidewalls, whereby said sidewalls, said top wall and said back wall define a hollow interior, a pair of doors, each said door pivotally attached to one of said sidewalls, said pair of doors closing off said hollow interior when positioned in a first closed position, a desk slidably supported between said pair of sidewalls and movable between an extended position wherein at least a portion of said desk extends beyond a front edge of said sidewalls and a retracted position completely within said hollow interior, whereby a space is provided between a front end of said desk in said retracted position and said pair of doors in said closed position, whereby said space receives said back of said chair when said chair is positioned within said hollow interior, said desk including a substantially flat desktop extending between said pair of sidewalls, a pair of vertical end plates attached to said desktop and a keyboard table slidably supported below said desktop extending between said pair of end plates, and a file cabinet having a top, back and pair of spaced sidewalls and a slidable drawer positioned therein, said file cabinet attached to one of said pair of sidewalls, said file cabinet further including a recess at a lower portion thereof, wherein said recess receives at least one of said legs of said chair when said chair is positioned within said hollow interior.

2. An armoire comprising:

a pair of spaced sidewalls;

a back wall interconnecting said sidewalls, whereby said sidewalls and said back wall define a hollow interior;

at least one door attached to one of said sidewalls closing off said hollow interior when in a first closed position; and a desk slidably supported between said sidewalls and movable between an extended position and a retracted position completely within said hollow interior, wherein said hollow interior receives a chair when said at least one door is in said closed position, wherein said sidewalls extend beyond a front edge of said desk when said desk is in said retracted position and wherein a space is provided between said front edge of said desk in said retracted position and said at least one door in said closed position, whereby said space receives a back of the chair positioned within the hollow interior when said at least one door is in said closed position.

3. The armoire of claim 2 wherein in said extended position at least a portion of said desk extends beyond a front edge of said sidewalls.

4. The armoire of claim 2 further comprising a shelf system positioned within said hollow interior above said desk.

5. The armoire of claim 4 wherein said shelf system includes:

i) a horizontal base shelf extending between said pair of sidewalls with a gap between said desk and said base shelf;

ii) a vertical divider extending up from said base shelf about midway between said pair of sidewalls; and iii) at least one adjustable shelf extending between said divider and one said sidewall.

6. The armoire of claim 4 wherein a space is provided between a front of said shelf system and said at least one door in said closed position.

7. The armoire of claim 4 further including at least one drawer within said hollow interior.

8. The armoire of claim 7 wherein said drawer is positioned within a file cabinet supported on the floor and having a top, back and pair of spaced sides with said file cabinet attached to one of said pair of sides.

9. The armoire of claim 8 wherein said file cabinet includes a recess at a lower portion thereof, wherein said recess receives a leg of the chair which is positioned within said hollow interior.

10. The armoire of claim 8 wherein said desk includes:

i) a substantially flat desktop extending between said pair of sidewalls;

ii) a pair of vertical end plates attached to said desktop; and iii) a keyboard table slidably supported below said desktop extending between said pair of end plates.

11. The armoire of claim 10 wherein said desk is slidably supported on outer track runners attached to said pair of end plates, each said outer track runner facing one said sidewall, and wherein said keyboard table is slidably supported upon inner track runners attached to said keyboard table, each said inner track runner facing one of said end plates.

12. The armoire of claim 10 further including a wrist rest on a front portion of said keyboard table.

13. The armoire of claim 2 further including a top wall attached to said back wall and extending between said sidewalls, said top wall closing an upper portion of said hollow interior.

14. The armoire of claim 2 further including a file cabinet having a top, back and pair of spaced sides and at least one drawer slidably positioned therein, with said file cabinet attached to one of said pair of sides and supported on the floor.

15. The armoire of claim 14 wherein said file cabinet includes a recess at a lower portion thereof, wherein said recess receives a leg of the chair positioned within said hollow interior.

16. The armoire of claim 15 wherein said desk includes:

i) a substantially flat desktop extending between said pair of sidewalls;

ii) a pair of vertical end plates attached to said desktop; and iii) a keyboard table slidably supported below said desktop extending between said pair of end plates.

17. The armoire of claim 16 wherein said desk is slidably supported on outer track runners attached to said pair of end plates, each said outer track runner facing one said sidewall, and wherein said keyboard table is slidably supported upon inner track runners attached to said keyboard table, each said inner track runner facing one of said end plates.

18. The armoire of claim 2 wherein said desk includes:

i) a substantially flat desktop extending between said pair of sidewalls;

ii) a pair of vertical end plates attached to said desktop; and iii) a keyboard table slidably supported below said desktop extending between said pair of end plates.

19. The armoire of claim 18 wherein said desk is slidably supported on outer track runners attached to said pair of end plates, each said outer track runner facing one said sidewall, and wherein said keyboard table is slidably supported upon inner track runners attached to said keyboard table, each said inner track runner facing one of said end plates.

* * * * *